US012329212B2

(12) United States Patent
Hong

(10) Patent No.: US 12,329,212 B2
(45) Date of Patent: Jun. 17, 2025

(54) WATER CONTAINER STORAGE COLLAR

(71) Applicant: Soo Wan Hong, Gyeongsangnam-do (KR)

(72) Inventor: Soo Wan Hong, Gyeongsangnam-do (KR)

( * ) Notice: Subject to any disclaimer, the term of this patent is extended or adjusted under 35 U.S.C. 154(b) by 0 days.

(21) Appl. No.: 18/273,799

(22) PCT Filed: Dec. 21, 2021

(86) PCT No.: PCT/KR2021/019543
§ 371 (c)(1),
(2) Date: Jul. 24, 2023

(87) PCT Pub. No.: WO2022/173112
PCT Pub. Date: Aug. 18, 2022

(65) Prior Publication Data
US 2024/0298718 A1 Sep. 12, 2024

(30) Foreign Application Priority Data
Feb. 10, 2021 (KR) ..... 10-2021-0018779

(51) Int. Cl.

| | |
|---|---|
| ***A41B 1/12*** | (2006.01) |
| ***A41B 3/04*** | (2006.01) |
| ***A41D 27/20*** | (2006.01) |
| ***A41D 31/06*** | (2019.01) |
| ***A41D 31/18*** | (2019.01) |

(52) U.S. Cl.
CPC ..... *A41B 1/12* (2013.01); *A41B 3/04* (2013.01); *A41D 27/202* (2013.01); *A41D 31/06* (2019.02); *A41D 31/18* (2019.02); *A41D 2400/46* (2013.01)

(58) Field of Classification Search
CPC ..... A41B 1/12; A41D 2400/46; A41D 31/06; A41D 31/18; A41D 27/202; F16L 59/024; A45F 3/20
See application file for complete search history.

(56) References Cited

U.S. PATENT DOCUMENTS 4,176,772 A * 12/1979 Danon ..... A45F 3/20 224/665
4,265,381 A * 5/1981 Muscatell ..... A45F 3/16 224/663

(Continued)

FOREIGN PATENT DOCUMENTS

KR 20-0188022 Y1 7/2000
KR 10-2001-0093046 A 10/2001

(Continued)

OTHER PUBLICATIONS

International Search Report for PCT/KR2021/019543 mailed Nov. 22, 2022 from Korean Intellectual Property Office.

*Primary Examiner* — Katharine G Kane
(74) *Attorney, Agent, or Firm* — Revolution IP, PLLC

(57) ABSTRACT

The present invention relates to a collar formed along the neck circumference of a top, and more particularly, to a water container storage collar that is formed with a storage part having a hollow collar, provided with a heat insulating material inside the storage part to constantly maintain the temperature of a beverage contained in a water container, and formed with a water intake pipe extending from the water container to drink water without using a hand.

4 Claims, 6 Drawing Sheets

(56) References Cited

U.S. PATENT DOCUMENTS 4,420,097 A * 12/1983 Motsenbocker ..... A45F 3/16 222/215
4,526,298 A * 7/1985 Boxer ..... A45F 3/16 222/529
4,921,141 A * 5/1990 Branum ..... B67D 3/00 222/175
5,188,266 A * 2/1993 Loulias ..... A45F 3/16 383/110
5,207,719 A * 5/1993 Janus ..... A45F 3/16 215/388
5,507,793 A * 4/1996 Hodges ..... A61F 7/02 607/114
5,571,260 A * 11/1996 Krug ..... A45F 3/16 224/660
5,669,529 A * 9/1997 Levit ..... A45C 1/04 222/105
6,173,866 B1 * 1/2001 Taylor, Jr. ..... B67D 1/0004 222/530
6,626,733 B1 * 9/2003 Knutson ..... A41D 13/0012 224/148.1
2002/0124294 A1 * 9/2002 McKenzie ..... A41D 13/0002 2/69
2004/0182870 A1 9/2004 Rodgers
2011/0113524 A1 * 5/2011 Sinder ..... A45F 3/20 224/148.1
2014/0013481 A1 * 1/2014 Lee ..... A45F 3/16 2/69
2019/0183195 A1 * 6/2019 Moore ..... A41D 23/00
2020/0196687 A1 * 6/2020 Hubbs ..... A41D 1/04
2020/0305525 A1 * 10/2020 Moore ..... A41D 23/00

FOREIGN PATENT DOCUMENTS

KR 20-0399157 Y1 10/2005
KR 20-0463939 Y1 12/2012
KR 20-2015-0001069 U 3/2015

* cited by examiner

【Figure 1】
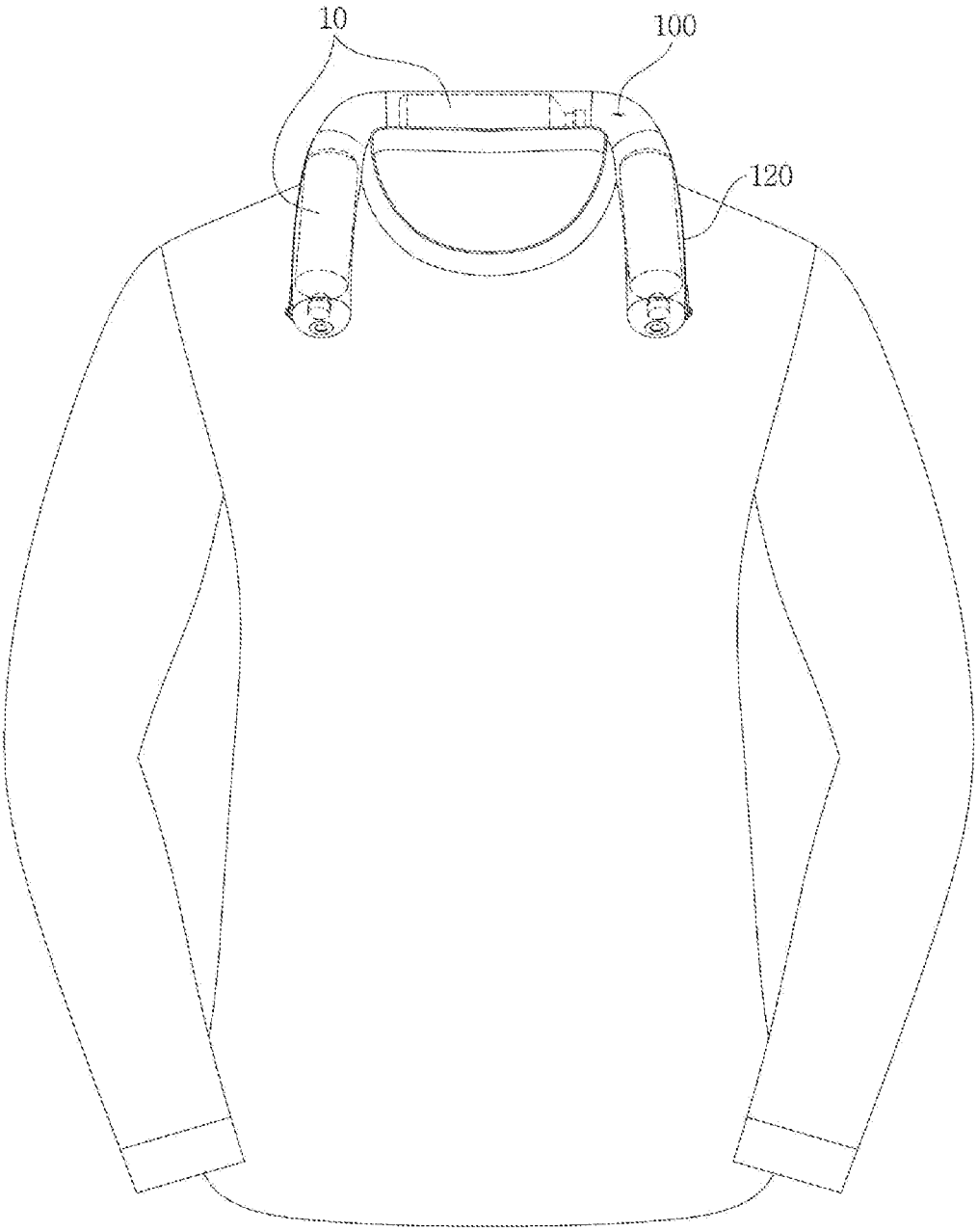

【Figure 2】
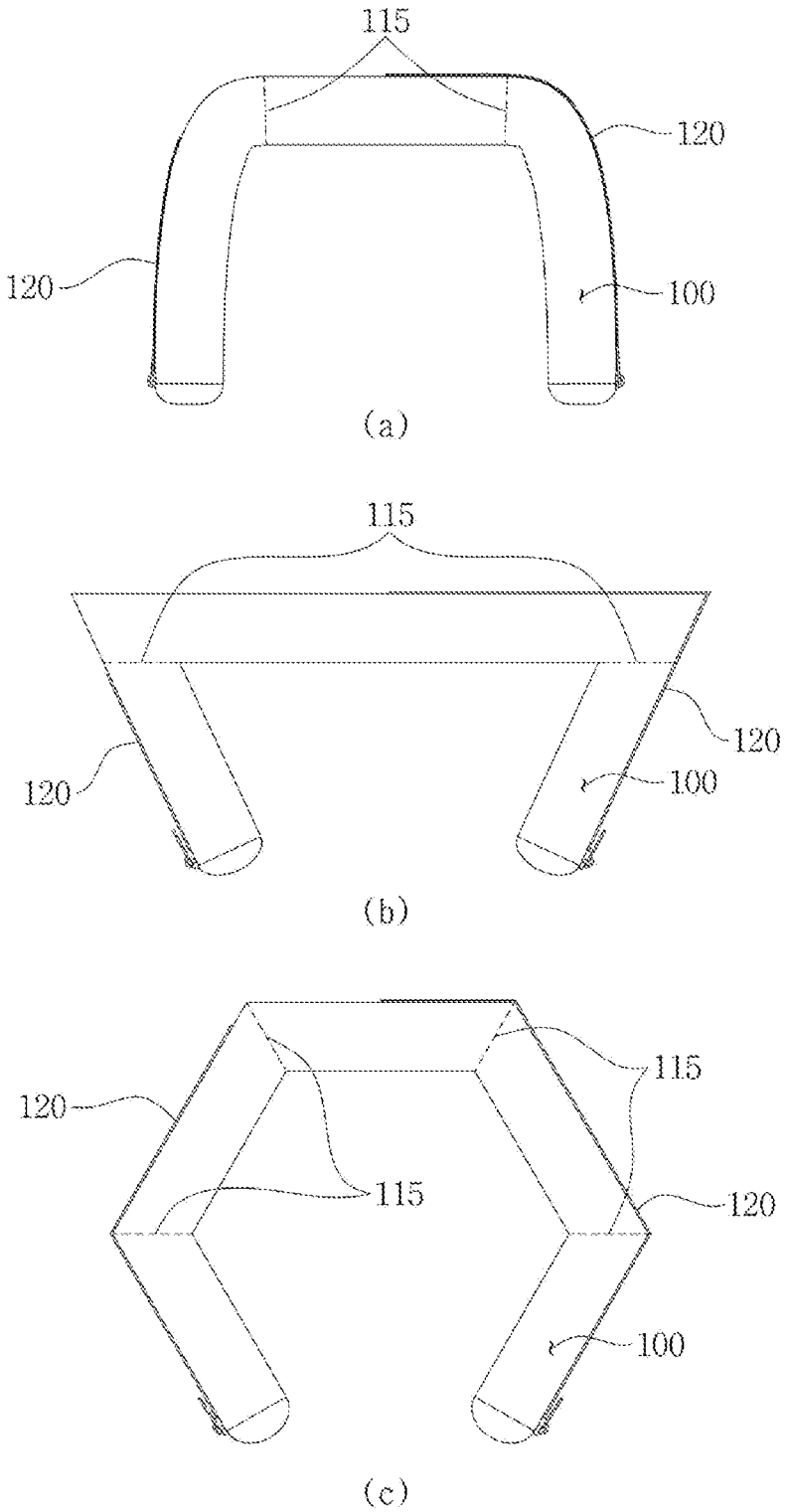

【Figure 3】
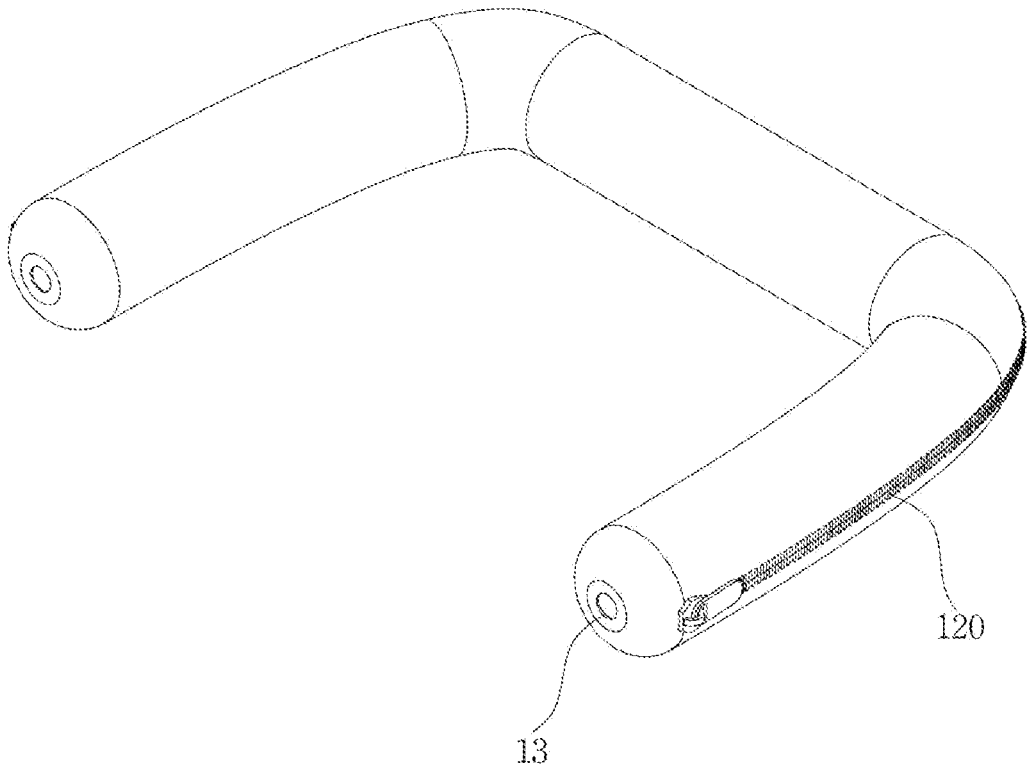

【Figure 4】
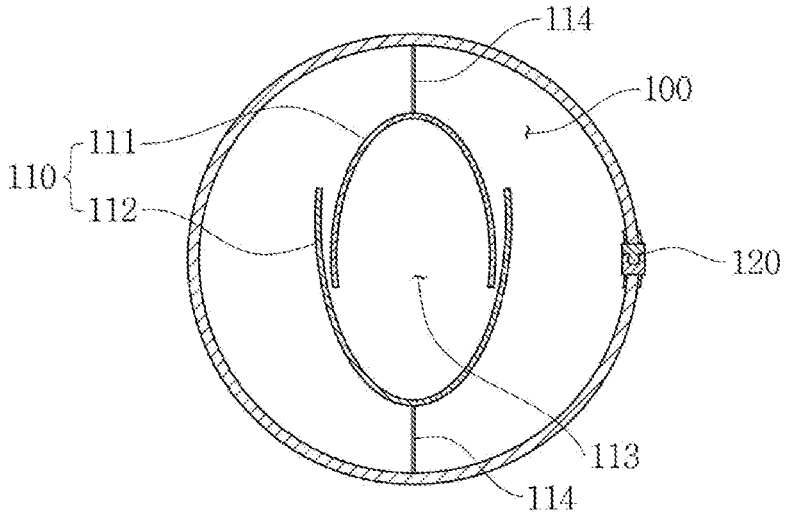
(a)
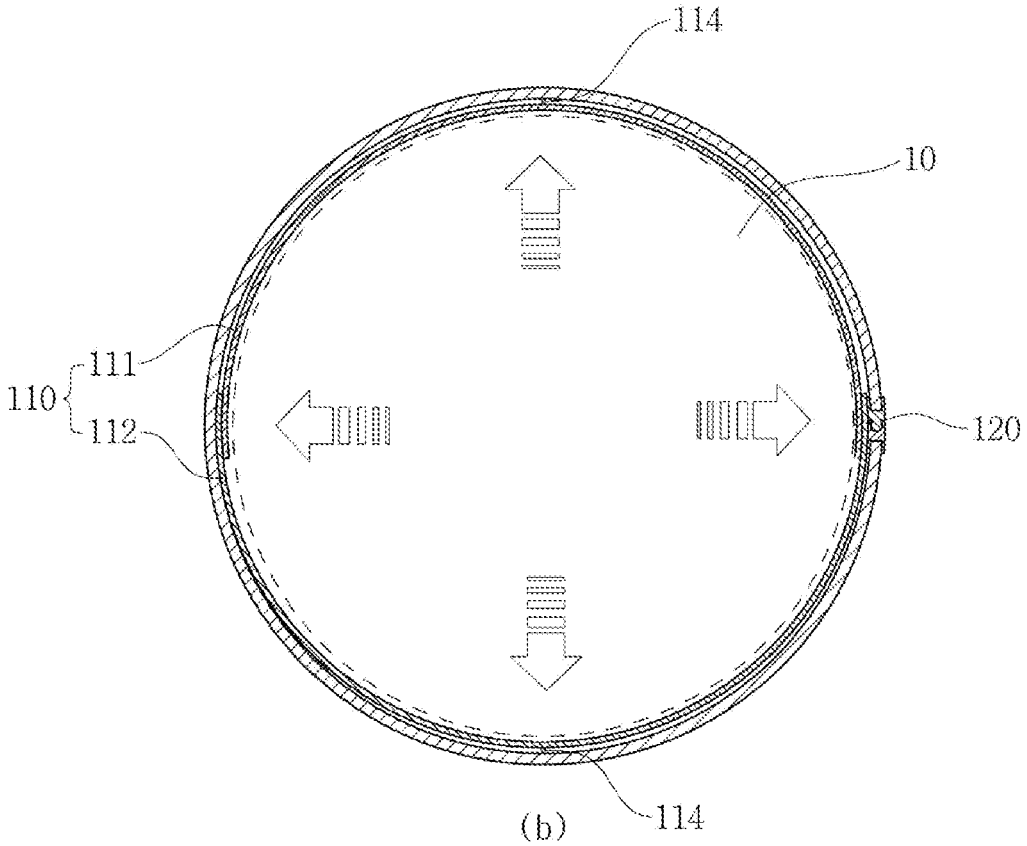
(b)

【Figure 5】
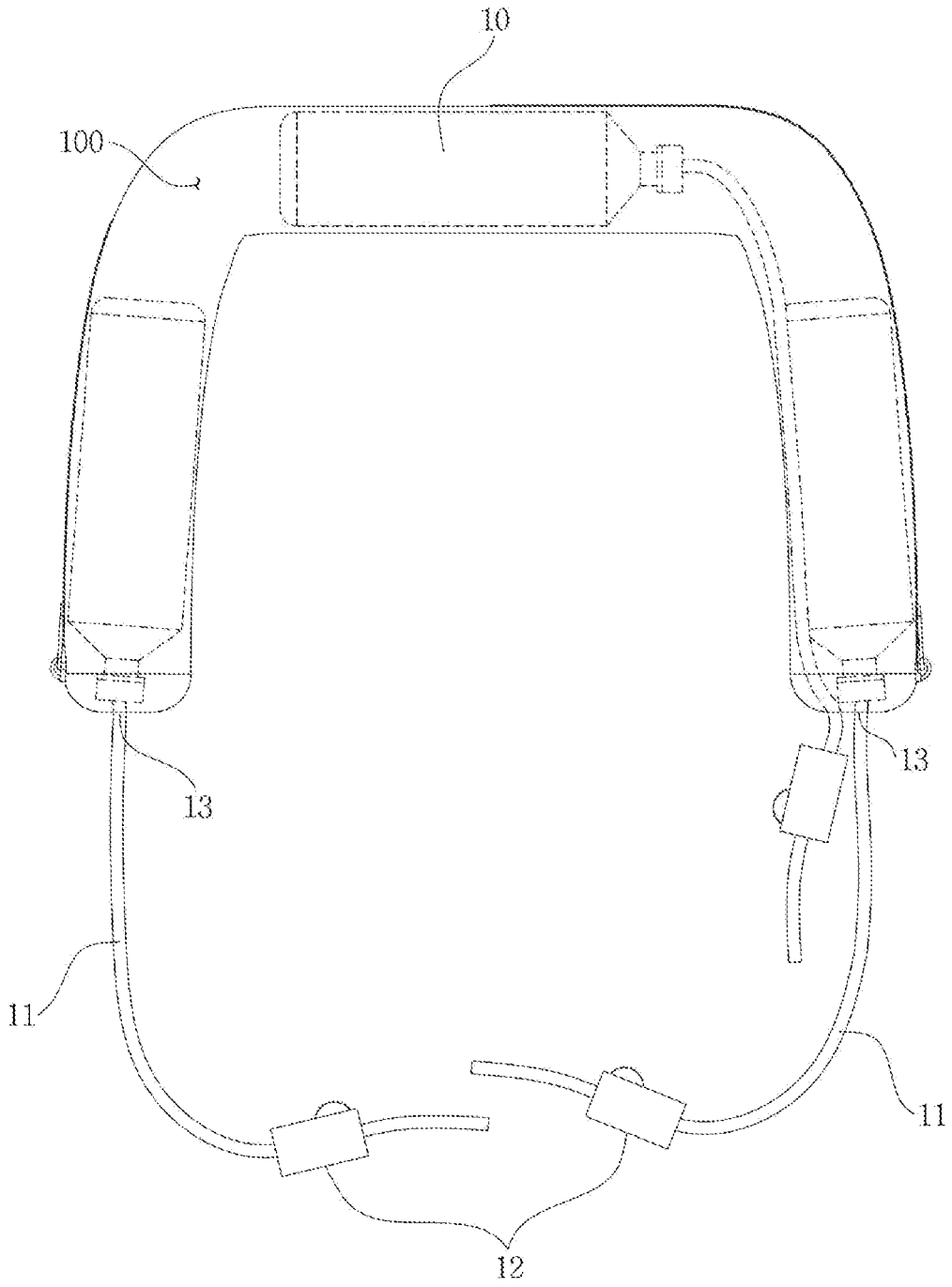

【Figure 6】
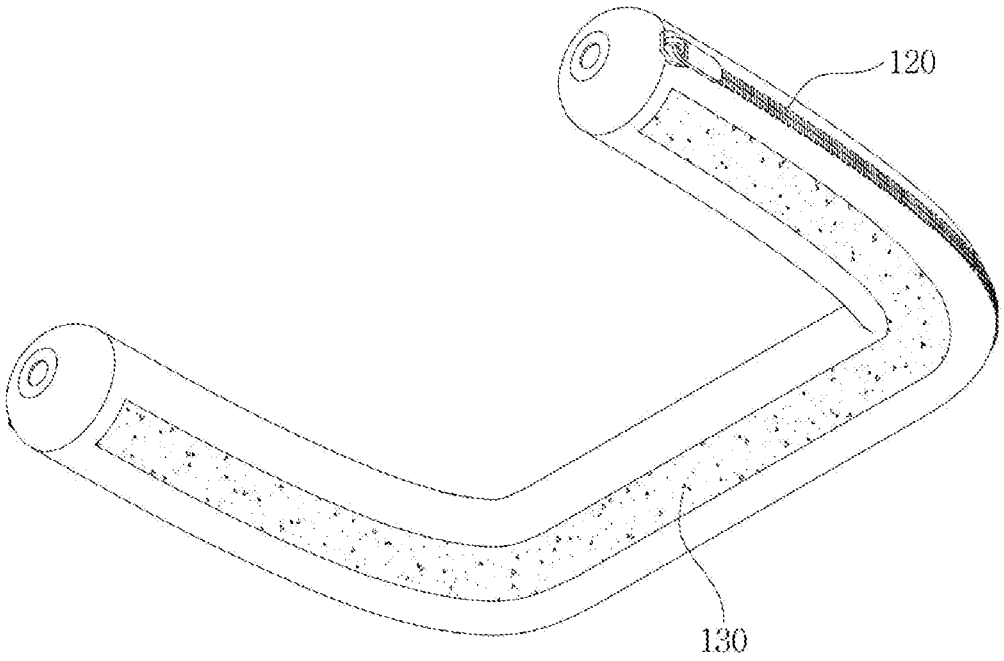

WATER CONTAINER STORAGE COLLAR

TECHNICAL FIELD

The present invention relates to a collar formed along the neck circumference of a top, and more particularly, to a water container storage collar that is formed with a storage part having a hollow collar, provided with a heat insulating material inside the storage part to constantly maintain the temperature of a beverage contained in a water container, and formed with a water intake pipe extending from the water container to drink water without using a hand.

BACKGROUND ART

In order to maintain a certain amount of water in the body, consistent water intake is necessary. In the summer when the body consumes and evaporates a lot of water, even with a little physical activity, water is released as sweat and evaporates. If being active outdoors for a long time, dehydration becomes severe, which may lead to the feeling of severe thirst, or the occurrence of body disorders or convulsions. In addition, since body heat is released to the outside due to a cold temperature in winter, it is recommended to drink warm beverages to maintain a body temperature while staying outdoors for a long time.

When he/she feels thirsty while doing outdoor activities such as exercise, travel, mountain climbing, fishing, or golf, or working in construction or construction sites, farmland, or other fields where drinking fountains are not installed, to easily replenish water, he/she fills the bottle with water.

Usually, a water container containing a beverage is put in a backpack, hung on a waist, or carried directly by hand.

In addition, in a conventional water container, in order to keep the temperature of the beverage in the water container hot or cold, a vacuum layer is formed in the water container or a heat insulating means such as wrapping with an insulation material such as a foam material was provided.

In the case of a PP bottle that may be easily carried around, when hot water is put therein, the bottle is deformed, and when cold water is contained and carried in summer, the bottle is affected by hot weather because there is no heat insulating means, and thus there is a problem in getting lukewarm or hot easily.

In addition, there is the hassle of needing to stop the activity to take the water container out of a bag while being busy with other activities such as mountain climbing and construction site work, and since the water container needs to be held with one hand, there is a problem of not being able to drink water in a busy place such as a construction site.

In addition, in the conventional water container, a heat insulating container provided with a heat insulating means has been used to maintain the temperature of the beverage. However, the heat insulating container is heavier than the PP bottle and inconvenient to be carried, and is formed at a high price, making it difficult to be prepared easily, and has a disadvantage that its heat insulating performance deteriorates over time.

Therefore, the development of a water container provided with a heat insulating means is on the rise to be easily carried and free hands when drinking water to improve work efficiency, and maintain an appropriate temperature to provide appropriate water in summer or winter.

PRIOR ART DOCUMENTS

Patent Documents (Patent Document 1) KR 20-0188022 (Y1) Apr. 24, 2000
(Patent Document 2) KR 20-0399157 (Y1) Oct. 13, 2005

DISCLOSURE

Technical Problem

In order to solve the problems, an object of the present invention is to provide a water container storage color capable of easily carrying water and rapidly drinking water when thirsty.

Another object of the present invention is to provide a water container storage color capable of easily finding a water container by eliminating the hassle of finding the water container in a bag when carrying the water container, having no discomfort without feeling the shaking of the water container even when moving, and having stability in carrying the water container while holding the water container on the body part.

Yet another object of the present invention is to provide a water container storage collar that can be easily inserted and withdrawn by having a zipper line when storing and carrying a water container.

Still another object of the present invention is to provide a water container storage collar capable of storing and carrying required things as well as a water container by making a space for storing the water container of an elastic material and having no restriction on the size of the water container.

Still yet another object of the present invention is to provide a water container storage collar capable of providing cool water in the summer and hot water in the winter by providing a heat insulating means in a space for storing the water container to maintain the temperature of water at an appropriate level.

Still yet another object of the present invention is to provide a water container storage collar capable of effectively blocking heat conduction by wrapping the outer surface of the water container even while constituting a heat insulating means into which the water container is inserted in two stages to conveniently insert and withdraw the water container into and from the heat insulating means.

Still yet another object of the present invention is to provide a water container storage collar capable of easily and quickly drinking water even while storing the water container without separately withdrawing a beverage contained in the water container when thirsty.

Still yet another object of the present invention is to provide a water container storage collar capable of coupling to, separating from or replacing a top by providing a means to be coupled to the end formed along the neck circumference of the top.

Technical Solution

In order to achieve the object, the present invention provides a water container storage collar, which is formed at the end of the neck of a top, in which a front portion is formed along the neck circumference in an open circular arc shape, and a storage part 100 having a hollow shape therein is formed, zipper lines 120 are formed with different lengths on both left and right sides along the outer surface of the storage part 100, and a water container 10 is inserted into the storage part 100.

The storage part 100 of the present invention is provided of an elastic material to be stretched when the water container 10 is inserted therein.

The water container storage collar further includes a heat insulating material 110 divided inside the storage part 100 of the present invention, in which the heat insulating material 110 consists of an upper heat insulating material 111 and a lower heat insulating material 112 with an open center, wherein the upper heat insulating material 111 and the lower heat insulating material 112 are formed in semicircular arc shapes having different diameters so that openings 113 are provided to face each other, and when the water container 10 is inserted into the heat insulating material 110, the heat insulating material 110 presses the storage part 100 from the inside and extends to the outside.

The upper heat insulating material 111 and the lower heat insulating material 112 of the present invention partially overlap with each other to contact each other when expanding and contracting, wherein the end of the small-diameter opening 113 is located inside the large-diameter opening 113.

The water intake pipe 11 may be connected to a cover of the water container 10 of the present invention, and the water intake pipe 11 extends to the outside through the through hole 13.

A coupling part 130 is further formed on the bottom surface of the storage part 100 of the present invention to be detachably attached to the neck of the top along a circular arc direction.

Advantageous Effects

According to the present invention, a water container storage color has an advantage of easily carrying water and rapidly drinking water when thirsty.

In addition, the present invention has advantages of easily finding a water container by eliminating the hassle of finding the water container in a bag when carrying the water container, having no discomfort without feeling the shaking of the water container even when moving, and having stability in carrying the water container while holding the water container on the body part.

In addition, the present invention has an advantage of being easily inserted and withdrawn by having a zipper line when storing and carrying a water container.

In addition, the present invention has an advantage of storing and carrying required things as well as a water container by making a space for storing the water container of an elastic material and having no restriction on the size of the water container.

In addition, the present invention has an advantage of providing cool water in the summer and hot water in the winter by providing a heat insulating means in a space for storing the water container to maintain the temperature of water at an appropriate level.

In addition, the present invention has an advantage of effectively blocking heat conduction by wrapping the outer surface of the water container even while constituting a heat insulating means into which the water container is inserted in two stages to conveniently insert and withdraw the water container into and from the heat insulating means.

In addition, the present invention has an advantage of easily and quickly drinking water even while storing the water container without separately withdrawing a beverage contained in the water container when thirsty.

In addition, the present invention has an advantage of coupling to, separating from or replacing a top by providing a means to be coupled to the end formed along the neck circumference of the top.

DESCRIPTION OF DRAWINGS

FIG. 1 is a perspective view of a state in which a water container storage collar according to the present invention is coupled to a top;

FIG. 2 shows (A) a plan view of a semicircular arc shape of the water container storage collar according to the present invention, (B) a plan view of a triangular shape thereof, and (C) a plan view of a pentagonal shape thereof;

FIG. 3 is a perspective view of a water container storage collar provided with a zipper line according to the present invention;

FIG. 4 is a cross-sectional view of a state in which a heat insulating material is provided inside a storage part according to the water container storage collar of the present invention;

FIG. 5 is a plan view of a state in which a water intake pipe is installed according to the water container storage collar of the present invention; and FIG. 6 is a perspective view of a state in which a coupling part is formed on a bottom surface of the water container storage collar of the present invention.

BEST MODE

Hereinafter, a preferred embodiment of the present invention will be described with reference to the accompanying drawings so that those skilled in the art can easily implement the present invention.

A water container storage collar according to the present invention is a collar formed along the neck circumference at the end of the neck of a top, in which a front portion is formed along the neck circumference in an open circular arc shape, and is wrapped around the back of the neck, and both ends are located on the left and right sides of the neck, a storage part 100 having a hollow shape therein is formed, zipper lines 120 are formed with different lengths on both left and right sides along the outer surface of the storage part 100, and a water container 10 is inserted into the storage part 100.

A conventional collar refers to a part that is adjusted while the cotton or the fabric constituting the top surrounds along the neck circumference. In the cold winter, the collar is pulled up to be close to the neck to protect against the cold, and in summer, the collar is positioned wide and low so as not to come close to the neck for protection against the hot weather.

The range of collars is various from collars designed to have practical functions to protect the neck or body temperature to collars provided with aesthetic functions to give a good impression with accessories attached.

The water container storage collar of the present invention is designed for practical functions such as maintaining body temperature and quenching thirst. A storage space is formed inside the collar of the top located close to the mouth for drinking water to store the water container 10 containing the beverage therein, and a water intake pipe 11 communicating with the water container 10 extends to the outside of the collar, so that a wearer may take water without holding the water container 10 with a hand, which is convenient and useful and helps in easily replenishing water even if users are busy without a break to drink water in a place such as a construction site.

In addition, the water container storage collar of the present invention is formed along the neck circumference of the top in the same manner as a place where the conventional collar is located, and the both ends are located on the left and right sides of the neck circumference on the front of the top, respectively.

The water container storage collar is formed in a circular arc shape, wraps the back of the neck, and both ends may be located on the clavicle side of the wearer. However, the shape thereof is not limited to the circular arc shape, and according to another embodiment, the shape may be formed in other curved shapes, a square shape, and a triangular shape to wrap around the neck. In the case of wrapping the neck in a polygonal shape such as a square shape or a triangle shape, it is preferable that both ends are located on the clavicle side while wrapping along the back of the neck, so the front side may be provided in an open shape.

The shape of the collar wrapped around the neck may be variously modified in consideration of the space division of the storage part formed therein and the length of the storage part.

In the case of a collar that wraps around the neck in a triangular shape according to another embodiment, a triangular collar in which any one vertex is open without being connected is attached to the end around the neck of the top, but the space of the storage part 100 may be divided into three portions such as left, right, and rear portions, a partition wall 115 is provided between each divided space to divide the space, and each storage space may be formed to be sufficient and spacious.

Alternatively, when the collar wraps around the neck and is formed in a pentagonal shape, like the triangular collar, the collar has an open front portion without vertices connected, and the space of the storage part 100 may be formed into five divisions, such as two left portions, two right portions, and one rear portion, and a partition wall 115 is provided between divided spaces to divide each space. At this time, each divided space is formed to be smaller than each divided space of the triangular shape, but a larger number of storage spaces are formed to store various objects for each purpose, such as a storage space for the water container 10, a storage space for tools, and a storage space for portable objects.

Accordingly, the configuration of the storage space may be variously modified according to the wearer's wearing place, purpose, and body shape, thereby enhancing convenience.

The water container storage collar of the present invention is formed with a hollow interior to form the storage part 100 capable of storing the water container 10 and various objects. The storage part 100 is formed along the circumference of the collar and the storage part 100 may be formed with respect to the entire circumference of the collar. Alternatively, the storage part 100 may be formed only on a portion of the collar.

The water container 10 containing the beverage may be stored and carried in the storage part 100, and when thirsty, water may be replenished by drinking a beverage in the water container 10 even in a place where a drinking fountain is not provided.

A zipper line 120 is provided on the outer cover surrounding the storage part 100. Since the storage part 100 may be opened or closed through the zipper line 120, objects may be stably stored in the storage part 100.

The zipper may be provided on the outer surface of the collar along a circular arc direction, and a plurality of zippers may be provided on both left and right sides.

On the outer surface of the left side, the zipper line 120 may be formed in a form extending from the left end to the rear side so that the left storage part 100 and the rear storage part 100 are able to be opened and closed. Accordingly, in order to insert and withdraw objects from the left storage part 100 and the rear storage part 100, the zipper line 120 formed on the left side may be adjusted to be opened and closed.

The right zipper line 120 is formed to an appropriate length at the right end, and the right storage part 100 may be opened and closed through the right zipper line 120.

Alternatively, the zipper line may be provided in a single form from the left end to the right end along the circular arc.

The storage part 100 is made of an elastic material that is not limited in size and shape when storing the water container 10 or objects. Accordingly, when the water container 10 is not inserted into the storage part 100, the volume of the storage part 100 decreases, and when the water container 10 is inserted and carried, the volume of the storage part 100 increases.

Since the storage part 100 is made of an elastic material, not only the water container 10, but also daily supplies such as car keys, wallets, and mobile phones are able to be stored, and tools and the like frequently used when working outside the site may be stored and taken out.

In addition, the storage part 100 made of an elastic material has a small volume when the water container 10 or an object is not stored, so that it does not cause cumbersome inconvenience to the wearer, and when the water container 10 or an object is inserted, the water container 10 or the object is able to be stored freely because the outer cover of the storage part 100 is stretched regardless of its shape and size.

The heat insulating material 110 is included inside the storage part 100 to cool or warm the temperature of the beverage when the water container 10 containing the beverage is inserted.

In hot summer, water inside the body is discharged through sweat, and the body temperature rises to have a risk of heat stroke, so that cool water needs to be drunk. However, due to the sweltering temperature outside, the temperature of the beverage soon becomes lukewarm or hot. Even in winter, there are many cases where a warm beverage prepared to maintain the body temperature cools down quickly and has no great effect. In order to prevent the problem and help in regulating the body temperature, the heat insulating material 110 may be provided inside the storage part 100 to maintain a constant temperature of the beverage in the water container 10.

The heat insulating material 110 is divided into an upper heat insulating material 111 and a lower heat insulating material 112, which consist of two stages. The heat insulating material 110 is formed in a hollow cylindrical shape, but when the cross section thereof is cut based on the horizontal line, the heat insulating material 110 located above a vertical line is formed as the upper heat insulating material 111, and the heat insulating material 110 located below the vertical line is formed as the lower heat insulating material 112.

The cross sections of the upper heat insulating material 111 and the lower heat insulating material 112 are formed in a semicircular arc shape. An opening 113 that is open so that the upper and lower heat insulating materials are opened is disposed in a direction facing each other at the upper and lower portions, respectively. The cross section of the upper heat insulating material 111 and the cross section of the lower heat insulating material 112 are hollow therein, so that the water container 10 may be stored inside the hollow.

In addition, a hard ring (not illustrated) surrounding the outer circumference of the heat insulating material 110 may be further constituted on each of the upper heat insulating material 111 and the lower heat insulating material 112. Since the cross section of the ring is formed in a semicircular arc shape according to the cross-sectional shape of the heat insulating material 110 and surrounds the outer circumference of the heat insulating material 110, the semicircular arc shapes of the upper and lower heat insulating materials may not be broken but maintained.

The ring (not shown) may be provided to be spaced apart from each other at a predetermined distance in a circular arc direction along the neck circumference. As the frequency of insertion and withdrawal of the water container 10 into and out of the heat insulating material 110 increases, the shape of the heat insulating material 110 may collapse. A hard ring (not shown) may prevent the shape from collapsing due to an increase in the number of uses, thereby improving the durability of a product.

The upper and lower heat insulating materials are coupled to the outer cover of the storage part 100 through elastic bodies 114 formed on the upper and lower surfaces of the inner surface of the storage part 100. In the elastic body 114, the water container 10 is inserted into the heat insulating material 110, so the that heat insulating material 110 is pushed outward to expand the inner space and transmit a pressing force to the outer cover of the storage part 100.

In addition, when the water container 10 is not inserted into the heat insulating material 110, the heat insulating material 110 is reduced inward, thereby reducing the volume of the storage part 100.

One or more elastic bodies 114 may be formed on the upper and lower portions, respectively. The heat insulating material 110 may be supported at one place supporting the upper heat insulating material 111 and at one place supporting the lower heat insulating material 112. Alternatively, a plurality of elastic bodies 114 are formed on the upper and lower portions, respectively, so that the upper and lower heat insulating materials may be more stably supported in several places.

In addition, the elastic body 114 is not a shape connecting the inner surface of the storage part 100 and the outside of the heat insulating material 110, but may be provide in a curved plate shape to be wrapped along the outer circumference of the heat insulating material 110. Accordingly, the water container 10 is inserted into the heat insulating material 110 to expand the inner space of the heat insulating material 110, and when the heat insulating material 110 is stretched, the plate-shaped elastic body 114 strongly presses the outer surface of the water container 10 with the inner circumference of the heat insulating material 110, thereby effectively insulate the heat without unclosed gaps.

The length of the heat insulating material 110 is shorter than that of the storage part 100. That is, the end of the heat insulating material 110 is formed to be spaced apart from the end of the storage part 100 by a predetermined interval, and a spare space is formed from the end of the storage part 100 to the end of the heat insulating material 110.

Accordingly, when the water container 10 is to be inserted into the heat insulating material 110, first, the outer surface of the storage part 100 is opened by opening the zipper line 120, and the end of the heat insulating material 110 is formed to be spaced apart from the end of the storage part 100 to form an extra space, so that the water container 10 may be inserted into the heat insulating material 110 through the extra space.

When the water container 10 is inserted into the heat insulating material 110, the heat insulating material 110 presses the outer cover of the storage part 100 outward, and the outer cover of the storage part 100 made of an elastic material is stretched in a pressed direction, so that the inner space is expanded.

As illustrated in FIG. 4, the ends of the openings 113 of the cross sections of the upper heat insulating material 111 and the lower heat insulating material 112 are provided in contact with each other. The openings 113 of the upper and lower heat insulating materials have different diameters, and the small-diameter opening 113 is located inside the large-diameter opening 113. The outer surface of the end of the small-diameter opening 113 is in contact with the inner surface of the large-diameter opening 113.

When the water container 10 is inserted and the inner space of the heat insulating material 110 is expanded, the end of the small-diameter opening 113 does not deviate from the inside of the large-diameter opening 113, so that the upper and lower heat insulating materials tightly wrap the outer surface of the water container 10, thereby improving a heat insulating effect.

Even if the water container 10 is removed from the inside of the heat insulating material 110 and the inner space is reduced, the end of the small-diameter opening 113 remains in contact with the inner surface of the large-diameter opening 113.

After the water container 10 is inserted into the heat insulating material 110, the inner surface of the small-diameter opening 113 surrounds the outer surface of the water container 10, and the outer surface of the small-diameter opening 113 is in contact with the inner surface of the large-diameter opening 113 to maintain a contact state between the upper heat insulating material 111 and the lower heat insulating material 112. Accordingly, the entire outer surface of the water container 10 may be wrapped with the heat insulating material 110 to maintain a heat insulating effect.

When the water container 10 is not inserted into the heat insulating material 110, the openings 113 of the upper and lower heat insulating materials are rolled up. The small-diameter opening 113 is rolled up inside the large-diameter opening 113, and the large-diameter opening 113 is rolled up along the outer surface of the small-diameter opening 113, thereby reducing the volume of the storage part 100.

In addition, even if the water container 10 is inserted into the heat insulating material 110, in order to maintain the contact state of the opening 113, protrusions (not shown) and locking jaws (not shown) may be formed on the upper and lower heat insulating materials. The end of the small-diameter opening 113 protrudes outward to form the protrusion (not shown) and the end of the large-diameter opening 113 protrudes inward to form the locking jaw (not shown), so that the protrusion (not shown) is locked to the locking jaw (not shown) to limit the stretching range, and even when the water container 10 is inserted, it is possible to prevent the end of the small-diameter opening 113 from deviating from the end of the large-diameter opening 113.

The water intake pipe 11 may communicate with a cap of the water container 10 stored in the storage part 100. In order to drink water conveniently and quickly, which is the object of the present invention, the water intake pipe 11 is formed as a means of inserting and carrying the water container 10 containing a beverage in the storage part 100 formed on the collar and drinking water when thirsty.

The water is drunk through the water intake pipe 11, thereby reducing the hassle of withdrawing the water container 10 out of the storage part 100. There is an advantage of being able to drink water without interruption even while working at the construction site.

A through hole 13 may be formed in the collar so that the water intake pipe 11 connected to the cap of the water container 10 may extend to the outside of the collar. A plurality of through holes 13 may be provided according to the quantity of the water container 10 to be inserted, and may be located on the left, right and rear sides.

A flow adjustment device 12 may be formed in the water intake pipe 11 to adjust a flow rate by adjusting the diameter of the water intake pipe 11 according to the movement of a wheel. When the beverage is taken, the wheel is rolled in a direction that does not press the water intake pipe 11 so that the beverage may flow along the water intake pipe 11, and when the beverage is not taken, the wheel is rolled in a direction that strongly presses the water intake pipe 11 to block the water intake pipe 11, so that the beverage does not flow.

A coupling part 130 may be formed on the bottom surface of the water container storage collar of the present invention so as to be coupled to and separated from the top. In more detail, the coupling part 130 detachably attached to the neck of the top is formed on the bottom surface of the storage part 100 of the collar along a circular arc direction, and the coupling part 130 may be formed in various forms such as a Velcro, a button, a zipper, etc., so as to be coupled with an end formed along the neck circumference of the top. When replacement due to washing and failure is required, the coupling part 130 may be released to be separated from the top, and collars having different shapes may also be coupled according to the purpose of use and the use.

The top may vary depending on a worker's task at construction or building sites. Even in various tops, the coupling part 130 is provided to couple the water container storage collar of the present invention, thereby enhancing the utilization.

A water container storage collar according to the present invention will be described with reference to one embodiment.

By opening the zipper line 120 formed on the outer surface of the collar of the present invention, the water container 10 or an object may be stored in the storage part 100. When the water container 10 is to be inserted into the heat insulating material 110, first, the outer surface of the storage part 100 is opened by opening the zipper line 120, and the end of the heat insulating material 110 is formed to be spaced apart from the end of the storage part 100 to form an extra space, so that the water container 10 may be inserted into the heat insulating material 110 through the extra space.

Since the outer surface of the water container 10 is wrapped with the heat insulating material 110, it is possible to maintain a cool temperature in summer and a warm temperature in winter.

When the wearer feels thirsty or drinks water to maintain the body temperature, the wearer may drink water through the water intake pipe 11 extending from the cover of the water container 10 to the outside of the collar. The wearer takes the beverage by holding the water intake pipe 11 in the mouth without a need to withdraw the water container 10 from the storage part 100 during work or hold and drink the water container 10 with one hand, so that the wearer may take the beverage by turning the head and holding the water intake pipe 11 in the mouth even while holding the object with both hands.

The water intake pipe 11 is opened by adjusting the wheel of the flow adjustment device 12 provided in the water intake pipe 11 to take the beverage, and after taking the beverage, the water intake pipe 11 may be blocked by rolling the wheel in a direction of strongly pressing the water intake pipe 11 to close the water container 10.

Since the water temperature of the beverage contained in the water container 10 is insulated by the heat insulating material 110, cool drinks in summer and warm drinks in winter may be provided to the wearer, thereby helping to quench thirst and maintain the body temperature.

According to the present invention, a water container storage color has an advantage of easily carrying water and rapidly drinking water when thirsty.

In addition, the present invention has an advantage of easily finding a water container by eliminating the hassle of finding the water container in a bag when carrying the water container, having no discomfort without feeling the shaking of the water container even when moving, and having stability in carrying the water container while holding the water container on the body part.

In addition, the present invention has an advantage of being easily inserted and withdrawn by having a zipper line when storing and carrying a water container.

In addition, the present invention has an advantage of storing and carrying required things as well as a water container by making a space for storing the water container of an elastic material and having no restriction on the size of the water container.

In addition, the present invention has an advantage of providing cool water in the summer and hot water in the winter by providing a heat insulating means in a space for storing the water container to maintain the temperature of water at an appropriate level.

In addition, the present invention has an advantage of effectively blocking heat conduction by wrapping the outer surface of the water container even while constituting a heat insulating means into which the water container is inserted in two stages to conveniently insert and withdraw the water container into and from the heat insulating means.

In addition, the present invention has an advantage of easily and quickly drinking water even while storing the water container without separately withdrawing a beverage contained in the water container when thirsty.

In addition, the present invention has an advantage of coupling, separating or replacing a top by providing a means to be coupled to the end formed along the neck circumference of the top.

EXPLANATION OF REFERENCE NUMERALS AND SYMBOLS

10: Water container 11: Water intake pipe
12: Flow adjustment device 13: Through hole
100: Storage part
110: Heat insulating material 111: Upper heat insulating material 112: Lower heat insulating material 113: Opening
114: Elastic body 115: Partition wall
120: Zipper line
130: Coupling part

The invention claimed is:

1. A water container storage collar, comprising:

a storage part (100) having a hollow shape therein; and a couple of zipper lines (120), each zipper line having different length on both left and right sides along an outer surface of the storage part (100), wherein a water container (10) is inserted into the storage part, wherein the storage part (100) comprises:

an upper heat insulating material (111) and a lower heat insulating material (112) disposed inside the storage part (100), wherein each of the upper and lower heat insulating materials has a semicircular arc cross-sectional shape with an opening (113), and wherein the upper and lower heat insulating materials have different diameters so that an end of a small-diameter opening is located inside a large-diameter opening; and a couple of elastic bodies (114), each elastic body formed on upper and lower surfaces of the inner surface of the storage part (100), wherein each elastic body (114) connects the upper and lower heat insulating materials to the storage part (100), wherein the upper heat insulating material (111) and the lower heat insulating material (112) are coupled to contact each other through the elastic bodies (114) in response to the water container (10) inserted into the storage part (100), wherein the water container storage collar is configured to be formed at an end of s neck of a top of a user, and wherein a front portion of the water container storage collar is formed along a neck circumference in an open circular arc shape.

2. The water container storage collar of claim 1, wherein the storage part (100) is provided of an elastic material to be stretched in response to the water container (10) being inserted therein.

3. The water container storage collar of claim 1, wherein a water intake pipe (11) is connected to a cover of the water container (10), and the water intake pipe (11) extends to the outside through a through hole (13).

4. The water container storage collar of claim 1, wherein a coupling part (130) is further formed on the bottom surface of the storage part (100) to be detachably attached to the neck of the top along a circular arc direction.

* * * * *